US005368378A

United States Patent [19]

Curtis

[11] Patent Number: 5,368,378

[45] Date of Patent: Nov. 29, 1994

[54] CONCEALED STORAGE CABINET

[76] Inventor: Donald G. Curtis, P.O. 235, Lewisbenny, Pa. 17339

[21] Appl. No.: 104,556

[22] Filed: Aug. 11, 1993

[51] Int. Cl.[5] ..... A47B 97/00

[52] U.S. Cl. ..... 312/204; 312/242; 49/398

[58] Field of Search ..... 49/398, 400; 312/204, 312/242, 227, 326; 217/56, 57

[56] References Cited

U.S. PATENT DOCUMENTS

| | | | |
|---|---|---|---|
| 1,707,013 | 3/1929 | Hoegger | 312/242 |
| 2,166,430 | 7/1939 | Green | 312/242 |
| 3,109,685 | 11/1963 | Skorupa | 312/204 |
| 3,140,134 | 7/1964 | Nairn | 312/204 |
| 3,697,363 | 10/1972 | Martinez | 312/204 |

*Primary Examiner*—Kenneth J. Dorner

*Assistant Examiner*—Gerald A. Anderson

*Attorney, Agent, or Firm*—John P. Halvonik

[57] ABSTRACT

A concealed cabinet structure having a door hinge that is concealed. The cabinet may be mounted into a wall in the area between studs. The hinge structure relies on an extended frame that provides a structure extending forward from the wall that the cabinet is mounted into. The side edges of the cabinet are of rounded construction and tapering to an edge. The hinge is mounted by plates to both the extended frame and the frame of the door. The door mounts with the tapered edge flush against the wall, thus preventing the viewing of the hinge from any angle that one could take. The door may have a slotted portion in order to place a mirror, picture or other decorative object on the face of the cabinet to deceive an intruder about the purpose of the cabinet.

2 Claims, 4 Drawing Sheets

CONCEALED STORAGE CABINET

BACKGROUND AND PRIOR ART

The invention relates to the field of cabinets and in particular to a construction for a cabinet that allows it to function as a concealed cabinet mounted into a wall between the studs. The hinge of the cabinet door cannot be seen by one who views the cabinet. The cabinet door may be decorated to appear as a mirror or picture to enhance the effect and discourage a would-be thief or burglar that the cabinet is nothing more than decorative.

It is thought that such a cabinet would be appreciated by home owners as a place for safekeeping valuables whose purpose cannot be known by merely visual inspection. To make such a cabinet whose true function is not readily discernible it is necessary to provide hinges that cannot be seen by the would-be thief. There are other cabinets such as U.S. Pat. No. 1,668,595 that are mounted into a wall and that have a door on a hinge that allows the door to open outward. However, it would be possible to view the hinge of this invention at an extreme angle, i.e., from the side and the burglar would then realize that this is a cabinet by sight.

Other prior art systems provide an outer hinge of such construction that the door would abut the outer frame of the cabinet structure when opened and thus make the cabinet useless or, at least, ineffective. Until the present invention; such a cabinet that has a door that opens to a large degree (almost 90 degrees) and whose hinges cannot be viewed has not been known.

It may be pointed out that such a cabinet as described herein does not need to be foolproof in order to carry cut it's intended function. While one could press upon the cabinet or carry out other procedures to determine if it is really a mirror this is not a concern here. Usually the burglar will not have the time to check this out. If the invention merely deceives the eye of the burglar upon his quick inspection this will confirm the belief that the cabinet is only a mirror or picture and the purpose will be achieved.

SUMMARY OF THE INVENTION

The invention is a concealed cabinet for mounting in walls whose hinges cannot be seen. The cabinet has a back wall and side walls which are preferably attached to wall studs by screws or other means. An outer frame provides an extended portion for mounting one end of the hinge. The hinge plates are mounted to the extended frame as well as the inside surface of the edge of the door. The sides of the cabinet should be of rounded construction and tapering to a sharp edge on one side of each edge. The door may have a slotted portion that allows a mirror, picture or other decorative item to be replaced on the face of the cabinet so that the visual appearance of the cabinet door maybe changed.

It is an object of the invention to provide a cabinet with a hinged door whose hinges cannot be seen when viewing the door from different angles.

Another objective of the invention is to provide a cabinet for storing valuables, jewelry, personal objectives, etc., that may be retrofitted into existing walls.

Another objective is to provide a cabinet whose purpose would not be known to would-be thieves.

Another objective is to provide a cabinet that is concealed and has a decorative outer appearance whose outer appearance may be changed as the user desires.

Another objective is to provide a cabinet whose function cannot be determined by viewing and has the outward appearance of a picture or a framed mirror.

Another objective is to provide a cabinet for storing jewelry and other valuables that are concealed, well-protected, and reasonable inaccessible to burglars. Other objectives will become known to those skilled in the art once the invention is shown and described.

DESCRIPTION OF THE PREFERRED EMBODIMENT

Figure 1:
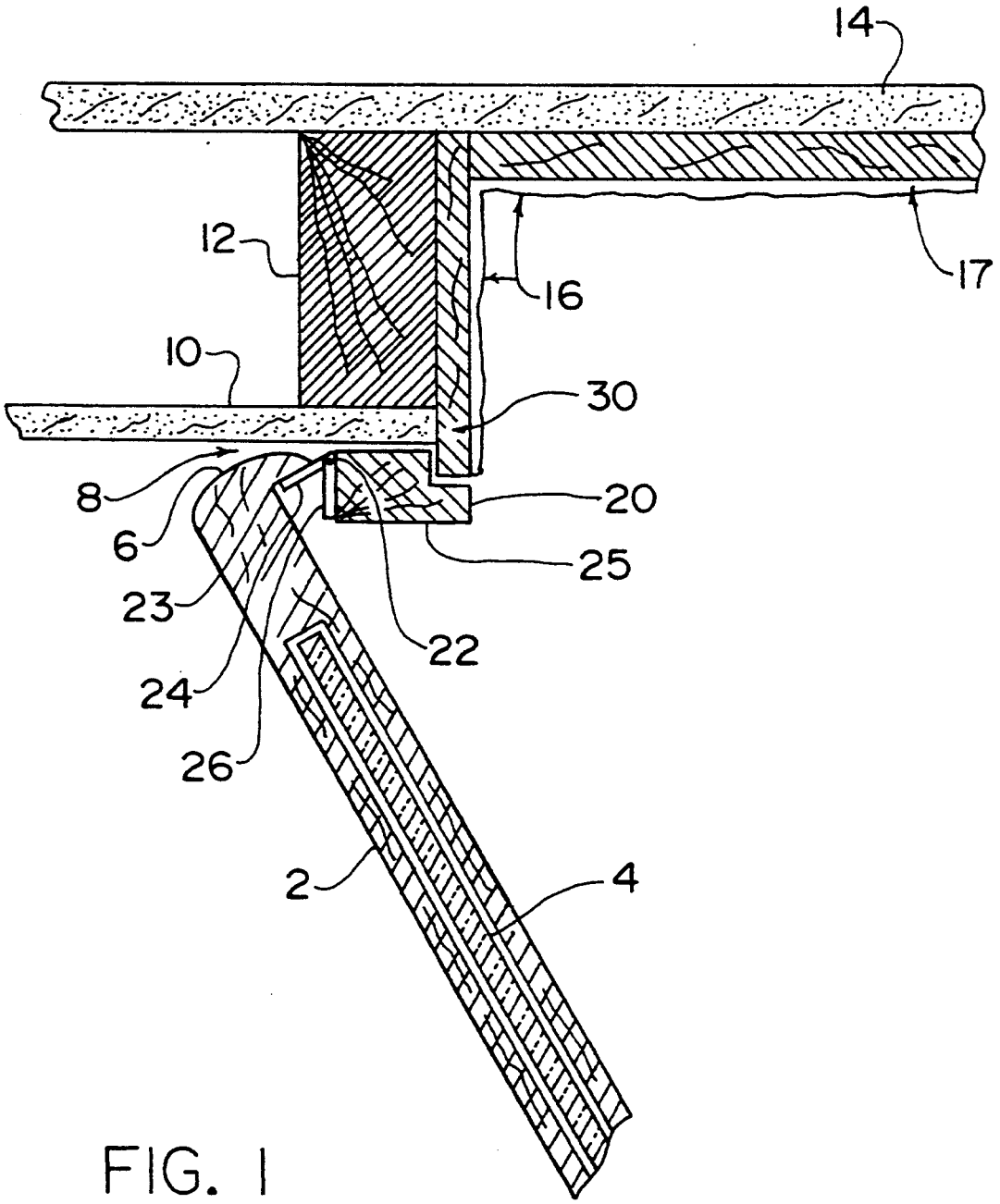
FIG. 1 Top view of cross section of hinge and door construction.

The overall construction of the invention is shown in FIG. 1. A hole is cut in the wall and the cabinet is mounted inside this area. Preferably, this hole should be in the area between studs 12, see FIG. 3. The door of the cabinet 2 is hinged and mounted to the cabinet frame 20 which covers this opening and provides access to the inside of the cabinet. The cabinet frame 20 is fastened to the side walls 30 of the cabinet as well as the top and bottom sides 32, 33. This then puts the cabinet into its proper position, when squared, the back sides of the cabinet frame 20 contacts the outside of the wall surface 10.

The door that is mounted to the front of the cabinet will have one side (6) that is connected to the hinge(s) (22) for opening the door. The outer surface (6) of this edge should be of rounded cross section as shown and should taper off to create a sharp edge (8) along that side of the edge that is flush with the wall, see FIG. 1. This outer surface needs to be rounded in order that the door may be opened without this side jamming against the wall and preventing the door from opening very far. The tapering toward the flush edge assures that this portion of the edge will be of minimal thickness to prevent this from happening.

Figure 2:
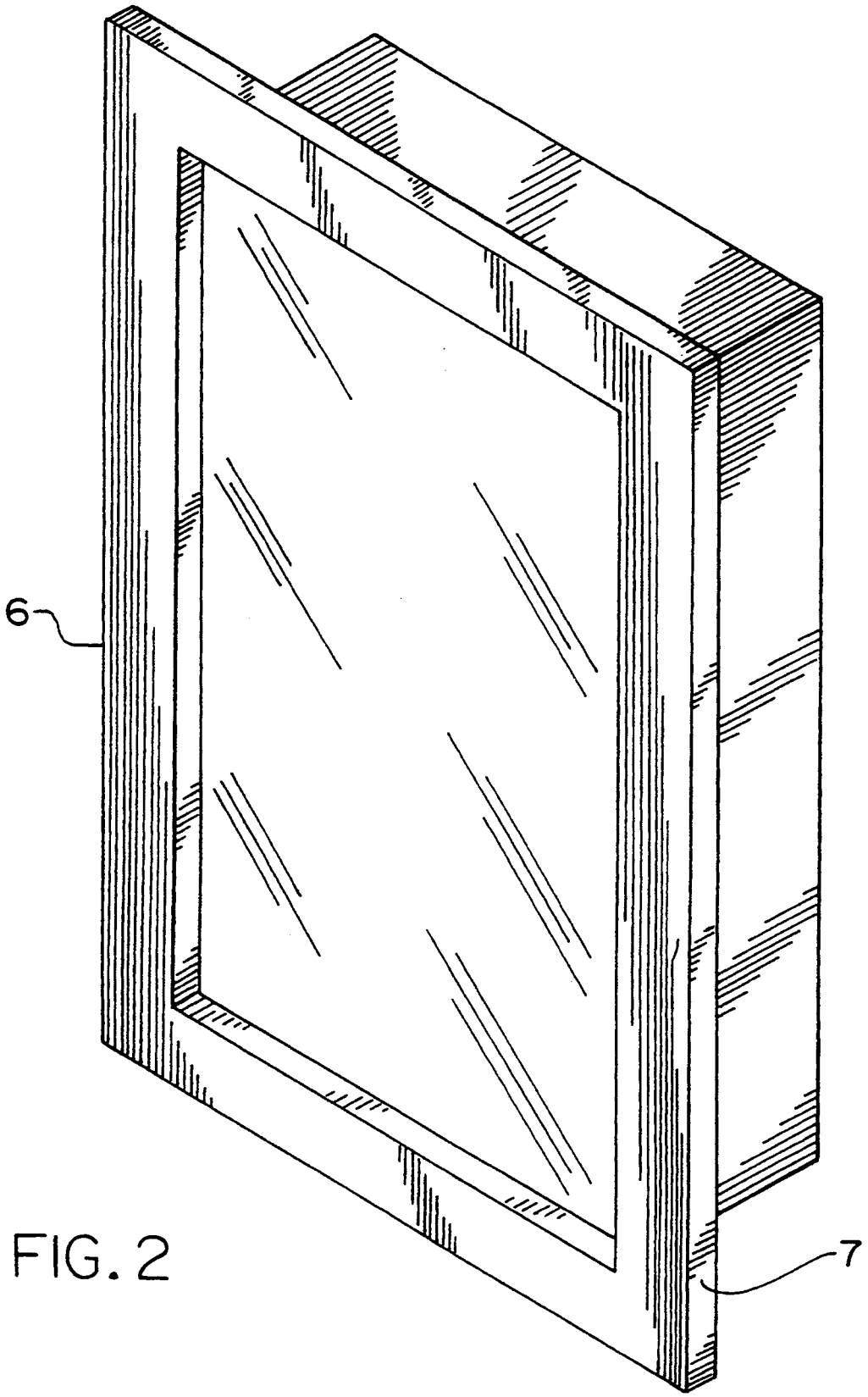
FIG. 2 Front view of cabinets.

It should be noted that that side edge 7 of the cabinet opposite edge 6 should be of similar rounded construction in order to enhance the visual effect, i.e. both sides should look the same in order to prevent intruders from realizing the nature of the cabinet. See FIG. 2. The upper and lower edges of the cabinet may also have this tapered effect for the same reasons.

The inner surface 23 of the side edge 6 should be of L shape as shown. This is so that the lower part of the L will abut the side of the frame 20 and the upper pare of the L will abut the front face 25 of the frame. Thus, the inner surface of this edge of the door will come flush against the framework for ease of fit.

The hinge (22) is of standard construction and has plates (24),(26), on both sides of a pivoting pin. Preferably two hinges would be used for the cabinet door although this may vary without violating the spirit of the invention. One plate of the hinge is attached to the side 26 of the framework (by screws, nails, or other means) and the other plate is attached to the underside 23 of the tapered edge of the door. This plate is attached to the lower portion of the L shape as shown. It may be attached by screws, nails, or other means.

This hinge then allows the door to swing open along an axis that exists as a line at the point where the tapered edge meets that point on the frame work where the frame work member contacts the wall. The door opens along this line and may be opened as far as the tapered edge will permit. It is possible to taper the edge enough so that the door may open almost 90 degrees.

A bracket or other means may also be used as a stop to limit the amount that the cabinet door may swing open. This may be necessary to prevent the side of the door from damaging the wall at 10 if and when the door is opened.

It is thought that the cabinet would find its greatest utility by being able to be mounted in existing walls. The ability to retrofit the cabinet is thought to make for a desirable product. As most modern walls are built with uniform distance between wall studs, the cabinets need be built in one size only (or very few sizes) and this will aid in production of the cabinets for additions to already existing homes.

In its preferred dimension the cabinet would be sized to fit between vertically aligned studs typically found in wall construction. The sides of the cabinet may be mounted to the studs on both sides of the cabinet through the use of screws or other means.

It is preferred that the inside of the cabinet have a series of pegs for holding necklaces, bracelets, neckties, etc. The pegs would preferably be arranged on the back wall of the cabinet and may be secured in a fashion that allows them to be replaced and/or moved about in different arrangements. Other methods may be used to enhance the storage capability of the cabinet.

As another option, the front door of the cabinet may be built with a slot running the length of the face of door as shown. This permits a mirror, picture, plaque or other decorative device (4) of planar construction to be slid into the slot in the door. The use of the slot allows this member to be replaced as desired in order to change the appearance of the face of the cabinet. It is thought that as the cabinet will be permanently mounted, the user may desire to change the visual appearance of the door. It is preferred that there be some decorative member on the face of the door in keeping with the purpose of deceiving one into thinking that the cabinet is merely a decorative mirror or painting.

Figure 3:
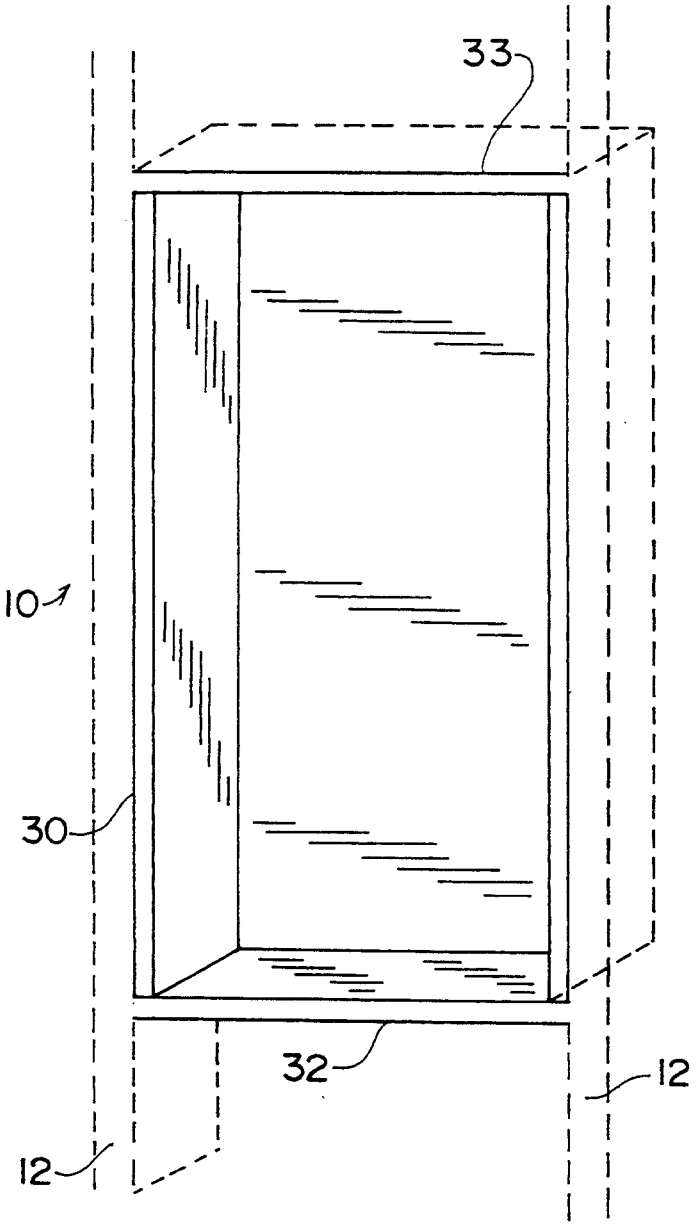
FIG. 3 Front view of cabinet in wall.
Figure 4:
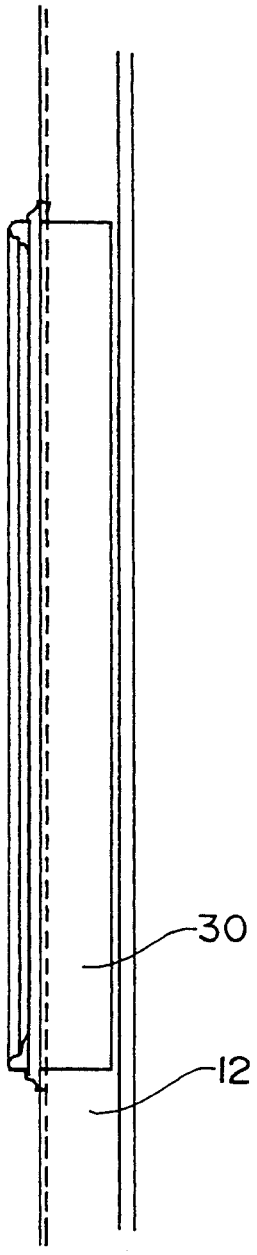
FIG. 4 Side view of cabinet in wall.
Figure 5:
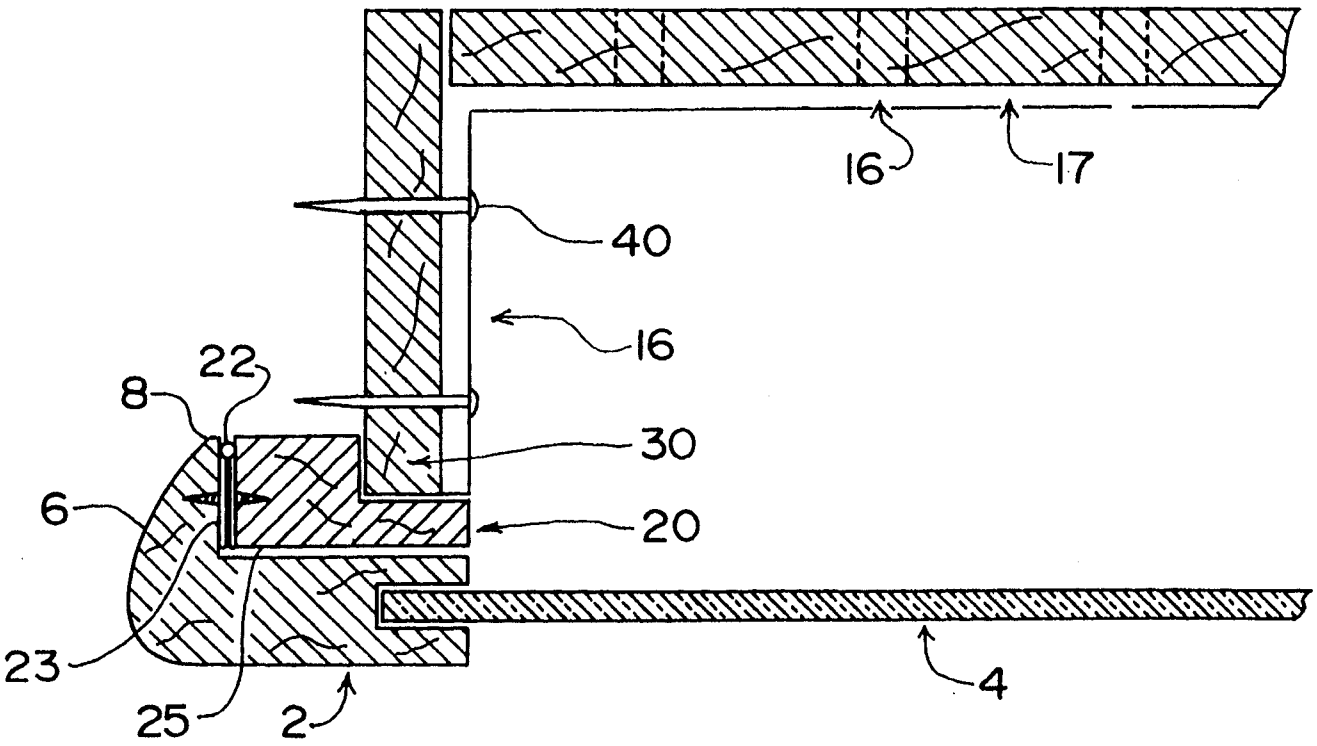
FIG. 5 Top view apparatus with door closed.

To mount the cabinet, the user should locate a section of the wall that is between two studs (12) and scribe an area of about the same dimensions as the cabinet and then, using a keyhole saw or other instrument, cut a hole in the wall this size, see FIG. 3 and 4. The completely assembled storage cabinet is inserted into the opening. When the outer cabinet. frame abuts the wall surface, the cabinet doorway can be opened and pre-inserted fasteners 40 placed into the sides of the walls of the cabinet and may be inserted into the 2'×4' frame, thus completing the installation process. The cabinets may be prefabricated so that they are of size to fit against the studs and be in close proximity to them.

It is preferred that the inside (16) of the cabinet be lined with Velveteen or other fabric that provides a finished appearance.

I claim:

1. A concealed cabinet structure for mounting along a main wall of a building structure comprising: a compartment having side walls and a rear wall in connection with said main wall so as to define a partially enclosed space having an entrance passage in said main wall, an outer frame member in connection with said main wall and bordering said entrance passage, said outer frame member having a front face, a side face, and a rear face, said rear face in connection with said main wall, a cabinet door having an outer surface, an inner surface, and two side edges, at least one of said edges being of a rounded shape, said inner surface having a long wall and at least one short wall, said long wall is generally parallel to said outer surface and said short wall is generally perpendicular to said long wall, said short wall in connection with said rounded side edge along a narrow edge, a hinge means comprising a pivoting pin and first and second plates, said first plate in connection with said side face of said frame member and said second plate in connection with said short wall so that said narrow edge of said door overlaps said side face of said frame member.

2. The apparatus of claim 1 wherein said cabinet door has a slot for the placement of an object in said slot.

* * * * *